United States Patent [19]

Day

[11] 4,348,958

[45] Sep. 14, 1982

[54] PROJECTILE HAVING IMPACT RESPONSIVE INITIATOR MEANS

[75] Inventor: Edward A. Day, Rancho Santa Fe, Calif.

[73] Assignee: Systems, Science and Software, La Jolla, Calif.

[21] Appl. No.: 150,061

[22] Filed: May 15, 1980

[51] Int. Cl.[3] ..... F42B 13/12; F42C 1/10

[52] U.S. Cl. ..... 102/499; 102/204

[58] Field of Search ..... 102/499, 396, 273, 272, 102/205, 204

[56] References Cited

U.S. PATENT DOCUMENTS

| | | | |
|---|---|---|---|
| 359,491 | 3/1887 | Bagger | 102/205 |
| 2,217,645 | 10/1940 | DeWilde et al. | 102/272 |
| 2,373,883 | 4/1945 | Ferrel | 102/499 |
| 2,459,175 | 1/1945 | Moore | 102/499 |
| 2,472,118 | 6/1949 | Moore et al. | 102/272 |
| 2,764,092 | 9/1956 | Massey | 102/499 |
| 2,883,931 | 4/1959 | Houck et al. | 102/275.8 |
| 3,062,143 | 11/1962 | Savitt et al. | 102/202.8 |
| 3,158,097 | 11/1964 | Brockway et al. | 102/275.5 |
| 3,978,791 | 9/1976 | Lemley et al. | 102/202.14 |
| 4,144,814 | 3/1979 | Day et al. | 102/202.14 |

FOREIGN PATENT DOCUMENTS

| | | | |
|---|---|---|---|
| 404549 | 1/1934 | United Kingdom | 102/272 |

*Primary Examiner*—Charles T. Jordan

*Attorney, Agent, or Firm*—Fitch, Even, Tabin, Flannery & Welsh

[57] ABSTRACT

An explosive projectile comprising a body having a flight end and defining an internal chamber having a main high explosive charge therein. The body has at least one passage therein which communicates with the internal chamber and intersects the exterior surface of the flight end. a detonation initiator material is disposed within the passageway and enables safe handling and high velocity projection of the projectile without ignition but is capable of detonation to effect detonation of the main explosive charge upon predetermined high velocity impact of the flight end with a target surface. A thin cover is preferably provided over the exposed end of the initiator passage. The detonator initiator material typically reaches high order detonation within a distance of one to one and one-half diameters from the impact end. The impact velocity on a metal target must, typically, be 0.5 kilometers per second or greater to effect detonation.

13 Claims, 5 Drawing Figures

PROJECTILE HAVING IMPACT RESPONSIVE INITIATOR MEANS

The present invention relates generally to explosive projectiles, and more particularly to an explosive projectile having novel impact responsive initiator means for effecting detonation of a main explosive charge upon predetermined impact of the projectile with a target surface.

It is a conventional practice in the art of explosive projectiles, such as bombs, rockets, percussion munitions, shrapnel munitions, directed-energy munitions and controlled expansion projectiles, to employ a main explosive charge within the body of the projectile and to utilize a detonation device to initiate detonation of the main charge. Such explosive projectiles are generally provided with a safe-and-arm device which enables the projectile to be safely handled and launched without danger of premature detonation with resulting injury to personnel and property. Such safe-and-arm devices are generally relatively complex structures and are subject to malfunction.

A primary object of the present invention is to provide a novel explosive projectile which can be safely manufactured, handled and fired without the need for a safe-and-arm device as has heretofore been required.

A more particular object of the present invention is to provide an explosive projectile having novel means for initiating detonation of a main high explosive carried within the projectile, the initiator means comprising an insensitive initiator material carried within one or more passages within the flight end of the projectile and adapted, when subjected to a predetermined impact force such as when the projectile impacts a metallic target surface or the like, to detonate and initiate detonation of the main explosive charge. The initiator facilitates safe manufacture, handling and firing or launching of the projectile without need for a safe-and-arm device as has heretofore been required.

A feature of the explosive projectile in accordance with the present invention lies in the provision of a plurality of passageways formed in the flight end of the projectile body so as to communicate with a chamber containing a main high explosive material, the passages having an insensitive initiator material disposed therein which is adapted for detonation on impact of the projectile with a target surface at a predetermined minimum impact force, but which is insensitive to sparks or fire and shock loads that may result during manufacture, handling and launching of the projectile.

Further objects and advantages of the present invention, together with the organization and manner of operation thereof, will become apparent from the following detailed description of the invention when taken in conjunction with the accompanying drawing wherein like reference numerals designate like elements throughout the several views, and wherein.

Figure 1:
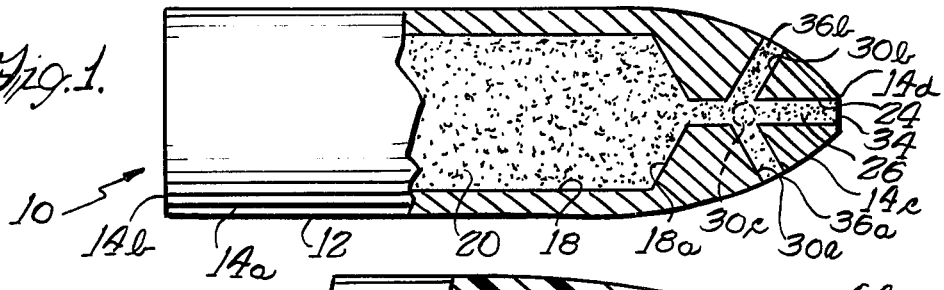
FIG. 1 is a elevational view of a projectile constructed in accordance with one embodiment of the present invention, a portion of the projectile being shown in longitudinal section to better illustrate the features of the invention.

Referring now to the drawing, and in particular to FIG. 1, an explosive projectile constructed in accordance with one embodiment of the present invention is indicated generally at 10. The projectile 10 may comprise any one of several types of projectile war heads, such as a percussion munition, a shrapnel munition, a directed-energy munition, or a controlled expansion projectile. Conventionally, such projectiles are adapted to be launched by a rifle or cannon, or propelled as a rocket or the like.

Very generally, the explosive projectile 10 utilizes an insensitive detonator material which is carried within one or more passages or columns in the projectile body in communication with a main explosive charge and is capable of detonation upon predetermined impact of the flight end of the projectile against a suitable target surface, such as a metallic target wall or the like, so as to initiate detonation of the main explosive charge carried internally of the projectile.

More particularly, the explosive projectile 10 includes a projectile body 12 which, in the embodiment illustrated in FIG. 1, is made from a suitable metallic material, although it is contemplated that the projectile body may be made from a suitable nonmetallic material. The projectile body 12 has a substantially cylindrical outer peripheral surface 14*a* terminating at its rearward end at a planar transverse end or base surface 14*b* and terminating at its forward end in an inwardly tapered surface 14*c* which defines the flight or nose end of the projectile. In the illustrated embodiment, the nose or flight end 14*c* terminates at its forwardmost end in a substantially planar nose surface 14*d* transverse to the longitudinal axis of the projectile body, although the nose end of the projectile body may initially be formed as a poined end if desired.

An internal substantially cylindrical chamber 18 is formed in the projectile body 12 so that the longitudinal axis of the internal chamber coincides with the longitudinal axis of the projectile body, the chamber 18 in the illustrated embodiment having a generally conical forward end surface 18*a*. A main explosive charge 20 is packed within chamber 18 in a conventional manner, the explosive charge being of known material and capable of detonation when subjected to a predetermined initiator pressure and temperature.

In accordance with an important feature of the projectile 10, at least one passage or column is formed in the projectile body 12 so as to communicate with the internal chamber 18 and open externally of the flight end of the projectile. In the embodiment of FIG. 1, an axial cylindrical passage 24 is formed in the projectile body 12 so that one end of the passage intersects chamber 18 and the other end of the passage opens outwardly of the nose end 14*d* of the projectile. An initiator material 26 is tightly packed into the passage 24 so as to completely fill the passage between the main explosive charge 20 and the forwardmost end of the passage. The initiator material 26 comprises an insensitive explosive material, such as PBXN-5, HNS, RDX composition C-4, and DIPAM, all of which are selected from military standard MIL-STD-1316B, although other secondary explosive materials may also be employed as the initiator material in the passage 24. PBXN-5 consists of about 4.5%–5.5% by weight of the copolymer vinylidene fluoride and hexafluoropropylene, with the remainder being HMX explosive which is 1,3,5,7-tetranitro-1,3,5,7-tetrazacyclooctane. HNS is an organic compound consisting of 2,2',4,4',6,6'hexanitrostilbene. The chemical composition of RDX composition C-4 is 1,3,5-trinitro-1,3,5-triazacyclohexane, with the remainder comprising 2.1% polyisobutylene, 1.6% motor oil and 5.3% di (2 hexyl) sebacate. DIPAM is a composition of 3,3'-diamino-2,4,6,2',4',6'-hexanitrobiphenyl. What is important is that the initiator material 24 be insensitive so as to enable safe manufacture, handling and firing or launching of the projectile 10 without need for a safe-and-arm device as has heretofore been required, but be responsive to a predetermined impact force to effect detonation of the initiator material.

Preferably, four branch passages, three of which are indicated at 30*a*, 30*b* and 30*c* in FIG. 1, are formed in the flight end of the projectile body 12 so as to intersect passage 24 and extend forwardly and outwardly in inclined relation to the longitudinal axis of the projectile. As characterized by branch passage 30*a* in FIG. 1, the branch passages 30*a–d* intersect the axial passage 24 at approximately its midlength and are inclined outwardly relative to the longitudinal axis of the projectile body so as to subtend angles of approximately 60° with the longitudinal axis of the projectile, although other angles of incline may be selected if desired. The passages 30*a–d* intersect the outer flight end surface 14*c* of the projectile body and are substantially equidistantly circumferentially spaced about the axis of the projectile body so as to maintain symmetry and balance of the projectile body about its longitudinal axis.

The branch passages 30*a–d* are each fully and tightly packed with initiator material 26 similar to passage 24. As will become more apparent hereinbelow, the branch passages 30*a–d* and associated initiator material contained therein are positioned so as to initiate detonation of the main explosive charge 20 upon oblique impact of the projectile 10 with a target surface, such as a metallic target wall. In this manner, ricochet of the projectile 10 when impacting a target surface in a direction other than normal thereto, i.e., at an oblique angle, is substantially prevented.

In one example of an explosive projectile 10 in accordance with the invention, the projectile body 12 was sized for use as the projectile for a 3006 30-caliber rifle. The projectile body 12 was made from a copper-coated lead formed to a diameter of approximately 0.30 inch at the cylindrical end 14*a* thereof and having an overall longitudinal length of approximately 1.06 inches. The projectile was formed with initiator passage 24 having approximately 0.080 inch diameter, and explosive material PBXN-5 was pressed into the initiator passage 24 at 20,000 psi so as to define a fully packed initiator column.

Preferably, a relatively thin metallic cover element 34, such as approximately 0.005 inch thick aluminum alloy or stainless steel, is provided over the outer end of passage 24 so as to protect the associated initiator material 26 disposed within passage 24. Similar end covers 36*a–d* are formed over the outer exposed ends of the branch passages 30*a–d*, respectively.

Figure 3:
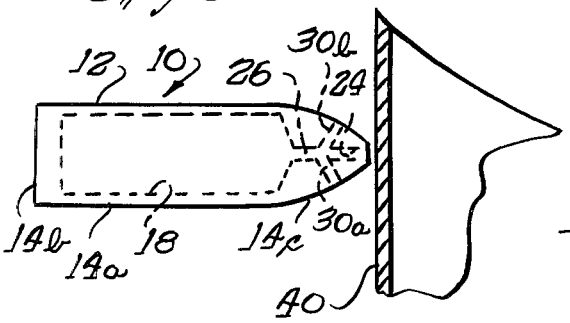
FIG. 3 is a schematic view illustrating initial impact of the projectile of FIG. 1 with a target wall.

FIGS. 3–5 illustrate the projectile 10 impacting a target wall at various angles of impact. FIG. 3 illustrates the projectile 10 at the point of initial impact with a metallic wall 40 of a target, the wall being approximately 0.030 inch or greater in thickness. When the projectile 10 impacts the target wall 40 in normal relation thereto, as in FIG. 3, at a predetermined minimum velocity sufficient to subject the initiator material 26 in axial passage 24 to a predetermined impact force to effect detonation of initiator material 26, the main explosive demolition charge is detonated as the projectile passes through the target wall 40. Should the now exploded projectile engage a second wall spaced rearwardly from wall 40 with sufficient impact force to penetrate the second wall, an opening is formed in the second wall which is of significantly greater area than the opening formed in wall 40 due to the expanded fragmented projectile body.

The initiator explosive 26 within passages 24 and 30*a–d* may be connected to the main explosive charge 20 through an explosive train of conventional material adapted, upon initial detonation of the initiator explosive material 26, to effect detonation of the main charge 20.

Figure 4A:
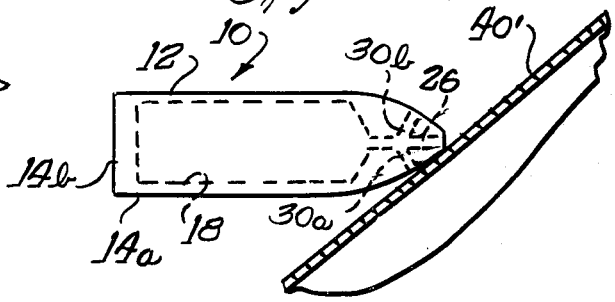
FIGS. 4*a* and 4*b* schematically illustrate impact of the projectile of FIG. 1 at an oblique angle with a target wall at various stages of deformation of the target wall.
Figure 4B:
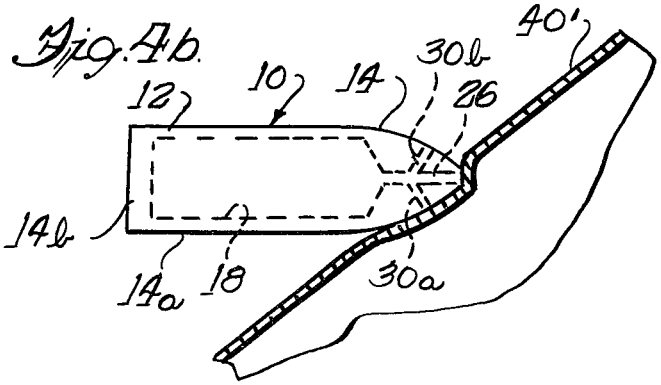

FIGS. 4*a* and 4*b* illustrate the projectile 10 impacting a generally planar target wall 40' at an oblique angle. It is seen from FIG. 4*a* that as the projectile 10 initially impacts wall 40, at an oblique angle, the branch passage 30*a* is substantially normal to the plane of wall 40'. As shown in FIG. 4*b*, impact of the projectile 10 against target wall 40' at a predetermined impact velocity causes the target wall to deform about the forward nose end 14*d* of the projectile so that at least one, and possibly two or three, of the branch passages 30*a–d* impact the deformed wall 40' to initiate detonation of the initiator material within the branch passages impacting wall 40' and thereby effect detonation of the main explosive charge 20. Detonation of the main charge 20 as the projectile impacts and deforms the target wall 40' prevents ricochet of the projectile from the target surface 40'.

Figure 2:
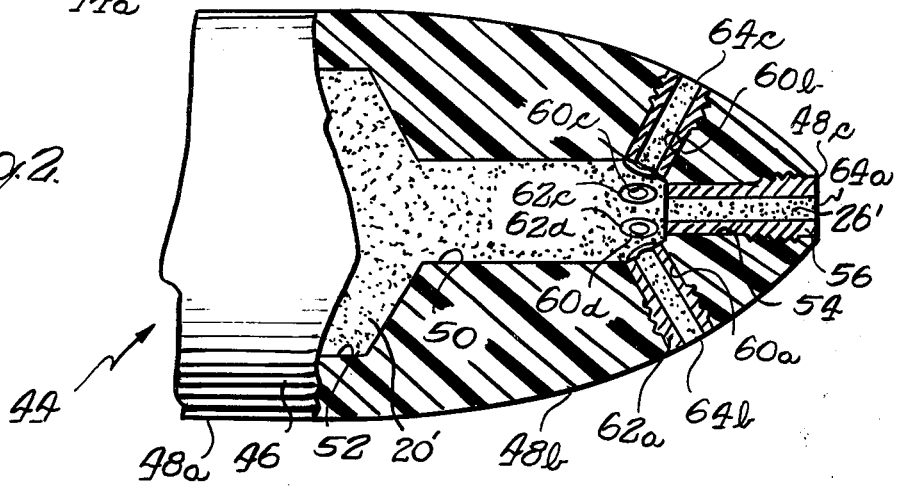
FIG. 2 is a fragmentary elevational view, on an enlarged scale and partly in longitudinal section, illustrating an alternative embodiment of an explosive projectile constructed in accordance with the present invention.

FIG. 2 illustrates a fragmentary portion of an alternative embodiment of an explosive projectile, indicated generally at 44, constructed in accordance with the present invention. The explosive projectile 44 finds particular application when an explosive projectile having a nonmetallic projectile body is desired. Explosive projectile 44 includes a projectile body 46 which is made from a nonmetallic material, such as a suitable plastic material, and has a generally cylindrical body portion 48*a* terminating at its rearward end in a planar end surface (not shown) and terminating at its forward end in an inwardly tapered flight end 48*b*.

The projectile body 46 has a cylindrical axial passage 50 formed therein which intersects a primary chamber 52 having a main explosive 20' therein. Passage 50 contains explosive material of conventional composition forming an explosive train leading to the main explosive charge in the larger chamber 52. In the embodiment of FIG. 2, an axial cylindrical passage 54 is formed in the forward end of the projectile body 46 so as to axially intersect passage 50 and open outwardly of the forward end of the projectile to form a generally planar forward end surface 48*c* on the projectile body. The axial passage 54 is of sufficient diameter to receive a metallic tubular cylindrical sleeve 56 which may be retained within passage 54 by suitable means such as a threaded connection, as illustrated in FIG. 2, or a suitable adhesive. The passage internally of the tubular sleeve 56 is packed with initiator material 26' similar to the passage 24 in the explosive projectile 10.

A plurality of cylindrical branch passages are formed within the flight end of the projectile body 46 so as to intersect the axial passage 50 and open outwardly of the flight end surface 48*b*. In the embodiment of FIG. 2, six such branch passages are formed in the projectile body 46, four of which are indicated at 60*a–d*. Each of the branch passages 60*a–d* is inclined outwardly from the longitudinal axis of the projectile body so as to subtend an angle of approximately 60 degrees with the axis of the projectile, and has an associated metallic tubular sleeve 62*a–d*, respectively, suitably affixed therein as by threaded connection within the corresponding branch passage in similar fashion to sleeve 56. The tubular sleeves 62*a–d* preferably have internal passages or bores substantially identical in size to the internal passage in sleeve 56 and are packed with an initiator material 26', such as PBXN-5 or other suitable material, in similar fashion to sleeve 56. Thin metallic end covers, three of which are indicated at 64*a*, 64*b* and 64*c* in FIG. 2, are formed over the outer ends of the sleeves 56 and 62*a–d* so as to protect the internal initiator material, the end covers 56 and 62*a–d* being substantially the same as the aforedescribed end covers 34 and 36*a–d* for the passages 24 and 30*a–d* in projectile 10.

The operation of the projectile 44 is substantially identical to the aforedescribed operation of the projectile 10 in that when the flight end of the projectile body 46 is caused to impact a target surface, such as the described metallic target wall 40 or 40', in normal or oblique relation thereto at a predetermined minimum velocity, the initiator material in one or more of the sleeves 56 and 60*a–d* will undergo detonation and initiate detonation of the main explosive charge 20' through the explosive train of material within chamber 50. The packed sleeves 56 and 60*a–d* thus define initiator columns.

While preferred embodiments of the present invention have been illustrated and described, it will be understood that changes and modifications may be made therein without departing from the invention in its broader aspects. Various features of the invention are defined in the following claims.

I claim:

1. An explosive projectile comprising a body having a forward flight end and defining an internal chamber, a main high explosive charge disposed within said internal chamber and being capable of detonation, at least one passage formed within said body in direct communicating relation with said chamber and opening outwardly of said flight end of said body, impact responsive initiator material disposed within said passage so as to completely fill said passage between said high explosive charge and the forwardmost end of said passage, and a thin cover formed over the outer exposed end of said passage, said initiator material enabling safe handling and high velocity launching of said projectile but being capable of impact responsive detonation to effect detonation of said main explosive charge upon predetermined impact of said flight end of said projectile with a target surface.

2. An explosive projectile as defined in claim 1 wherein said at least one passage is formed coaxial with the longitudinal axis of said projectile body.

3. An explosive projectile as defined in claim 1 wherein said cover is formed of a thin metallic material.

4. An explosive projectile as defined in claim 1 wherein said projectile body has a generally cylindrical body portion which terminates at its forward end in an inwardly curved flight end, said at least one passage being formed axially within said projectile so as to intersect the forwardmost end thereof.

5. An explosive projectile comprising a body having a forward flight end and defining an internal chamber, a main high explosive charge disposed within said internal chamber and being capable of detonation, at least one passage formed axially within said projectile body in communicating relation with said chamber and opening outwardly of said flight end of said body, and a plurality of branch passages formed in said flight end of said projectile body and communicating with said internal chamber and opening outwardly of said flight end, said branch passages being inclined relative to the longitudinal axis of said projectile body, said axial passage and said branch passages having initiator material disposed therein, the initiator material within said axial passage and each corresponding branch passage enabling safe handling and high velocity launching of said projectile but being capable of detonation to effect detonation of said main explosive charge upon impact of said projectile with a target surface such that the initiator material within an impacted one or more of said axial and branch passages is subjected to a predetermined impact force.

6. An explosive projectile as defined in claim 5 including a thin protective cover formed over the exposed end of each of said passages.

7. An explosive projectile as defined in claim 6 wherein said covers comprise thin metallic cover elements.

8. An explosive projectile as defined in claim 5 wherein said projectile body is made of a nonmetallic material, and including a tubular metallic sleeve retained within each of said passages formed in said flight end of said projectile body, said initiator material being disposed within the tubular sleeve in the corresponding passage.

9. An explosive projectile as defined in claim 5 wherein said projectile body has an axial passage formed therein communicating with said internal chamber and having an explosive train material disposed therein adapted to be detonated upon detonation of initiator material disposed within one or more of said passages.

10. An explosive projectile as defined in claim 5 wherein said projectile body includes four of said branch passages disposed in equidistant circumferentially spaced relation about the longitudinal axis of said body.

11. An explosive projectile as define in claims 1 or 5 wherein said initiator material comprises an insensitive explosive material taken from a group which includes PBXN-5, HNS, RDX composition C-4, and DIPAM.

12. An explosive projectile as defined in claims 1 or 5 wherein said initiator material comprises PBXN-5.

13. An explosive projectile comprising a projectile body made of a non-metallic material and having a forward flight end and defining an internal chamber, a main high explosive charge disposed within said internal chamber and being capable of detonation, at least one passage formed within said body in communicating relation with said chamber and opening outwardly of said flight end of said body, a tubular metallic sleeve retained within said at least one passage, and initiator material disposed within said passage, said initiator material enabling safe handling and high velocity launching of said projectile but being capable of detonation to effect detonation of said main explosive charge upon predetermined impact of said flight end of said projectile with a target surface.

* * * * *